US006870941B2

(12) United States Patent
Marnie

(10) Patent No.: US 6,870,941 B2
(45) Date of Patent: Mar. 22, 2005

(54) DIPOLE RADIATING DYNAMIC SPEAKER

(76) Inventor: Glenn A. Marnie, 270 Borrego Ct., Oceanside, CA (US) 92057

( * ) Notice: Subject to any disclaimer, the term of this patent is extended or adjusted under 35 U.S.C. 154(b) by 0 days.

(21) Appl. No.: 10/194,904

(22) Filed: Jul. 15, 2002

(65) Prior Publication Data

US 2004/0008857 A1 Jan. 15, 2004

(51) Int. Cl.[7] ..... H04R 1/02

(52) U.S. Cl. ..... 381/337; 381/353; 381/354; 181/161

(58) Field of Search ..... 381/346, 352, 381/353, 354, 355, 150, 312, 337, 397, 429, 430, 433, 349; 181/166, 151, 153, 155, 148, 150, 198, 199

(56) References Cited

U.S. PATENT DOCUMENTS 3,925,626 A * 12/1975 Stallings, Jr. ..... 381/430
4,377,219 A * 3/1983 King ..... 181/155
4,437,541 A * 3/1984 Cross ..... 181/151
5,109,416 A * 4/1992 Croft ..... 381/304
5,710,395 A * 1/1998 Wilke ..... 181/153
6,219,431 B1 * 4/2001 Proni ..... 381/397
6,411,723 B1 * 6/2002 Lock et al. ..... 381/431
6,504,939 B1 * 1/2003 Fukuda ..... 381/386
6,636,612 B1 * 10/2003 North et al. ..... 381/412
2001/0031063 A1 * 10/2001 Langford et al. ..... 381/397
2002/0067843 A1 * 6/2002 Abe et al. ..... 381/407

FOREIGN PATENT DOCUMENTS

JP 02003070095 A * 3/2003 ..... H04R/9/04

* cited by examiner

*Primary Examiner*—Curtis Kuntz
*Assistant Examiner*—Brian Ensey

(57) ABSTRACT

A dipole radiating dynamic speaker design comprises a diaphragm (32) providing a surface for radiating acoustic output, a voice coil assembly (36) for driving the diaphragm, and a magnet system for providing magnetic flux across the voice coil assembly. The speaker incorporates a vented pole flux conductor (42) and a vent adjacent to the diaphragm permitting the rearward acoustic output to propagate away from the diaphragm producing acoustic output as a dipole radiator.

A method of utilizing the dipole radiating dynamic speaker design for tweeter and mid-range speaker applications used in home, automotive, and professional audio systems is disclosed. In addition a novel enclosure design is disclosed that utilizes a front panel perimeter vent providing improvement of audio reproduction quality for mid-range speaker applications.

6 Claims, 8 Drawing Sheets

DIPOLE RADIATING DYNAMIC SPEAKER

BACKGROUND OF THE INVENTION

This invention relates to a dynamic speaker design utilizing a diaphragm, voice coil assembly, and magnet system producing acoustic output as a dipole radiator. The invention also relates to a method of utilizing the dipole radiating dynamic speaker design for tweeter and mid-range speaker applications used in home, automotive, and professional audio systems.

Dynamic speakers utilizing a diaphragm, voice coil assembly, and magnet system providing acoustic output as monopole radiators have been manufactured for many years and are still widely used in commercial, professional, and home applications. The dynamic speaker has endured as the most popular speaker design due to its low cost, compact design, ease of use, and reliability. However, the dynamic monopole speaker audio reproduction quality is considered inferior to other more expensive speaker design technologies such as electrostatic, planar magnetic, and ribbon type.

A dynamic speaker system generally utilizes multiple dynamic speakers that provide acoustic output for specific frequency ranges. Dynamic speakers that provide mid-frequency and high-frequency acoustic output are generally known as mid-range and tweeter units, respectively. This patent addresses the design deficiencies with prior art mid-range and tweeter dynamic speakers.

A brief explanation of acoustic wave propagation is necessary to effectively describe the prior art dynamic speaker design deficiencies. A speaker generates acoustic wave output by converting an electrical signal into mechanical diaphragm motion. In operation, the diaphragm vibrates proportional to the electrical signal passing through the voice coil producing forward and rearward propagating acoustic wave output. The diaphragm movement produces half of the acoustic output energy in the forward direction and half in the rearward direction. This fundamental wave propagation principal is common to all speakers producing acoustic output in response to diaphragm motion.

In general, speakers that provide low frequency output utilize an enclosure to prevent acoustic cancelation caused by the interaction of the forward and rearward wave propagation. Typically, midrange and tweeter dynamic speakers are mounted in a common enclosure with other low frequency producing dynamic speakers. The low frequency dynamic speaker produce acoustic output of sufficient magnitude within the enclosure that damage to the mid-range and tweeter diaphragms would result if acoustic isolation were not provided. As a result, the prior art of mid-range and tweeter dynamic speaker design incorporate a means of blocking the acoustic output from other speakers in order to isolate and protect the diaphragm. These mid-range and tweeter dynamic speakers produce acoustic output in only one direction as monopole radiators.

The main flaw in the prior art dynamic speaker design is the incorporation of the acoustic wave blocking means. The acoustic wave blocking means also acts to block the rearward propagating acoustic output from the tweeter or mid-range speaker. As a result, the trapped rearward propagating acoustic output is reflected within a space internal to the speaker causing acoustic wave distortion known as constructive and destructive interference. This distorted acoustic output is dissipated primarily on the diaphragm due the reflective characteristic of the materials utilized in the dynamic speaker construction. Subsequently, the forward propagating acoustic output is corrupted due to the dissipation of the distorted acoustic output from the rearward propagating acoustic output. In effect, half of the dynamic monopole speaker acoustic output energy is distorted and dissipated on the diaphragm causing significant degradation of the forward propagating acoustic output accuracy. As a result the dynamic monopole speaker design produces inferior imaging resolution and audio reproduction accuracy compared to other speaker design technologies.

The prior art of dynamic speaker design does not effectively address the audio reproduction quality degradation caused by the containment of the rearward propagating acoustic output.

The following drawings illustrate prior art mid-range and tweeter dynamic monopole speaker design. Those skilled in the art of dynamic speaker design, operation, and manufacture will be familiar with the construction and operation. The following drawings illustrate prior art dynamic speaker design deficiencies described above.

FIG. 1 illustrates a typical prior art dynamic monopole speaker design. Dynamic mid-range and tweeter speakers generally contain the following main components: a diaphragm 10, a voice coil assembly 12 containing the voice coil and former, front and rear flux conductor plates 14 and 16, a solid pole flux conductor 18, a permanent magnet 20, and a mounting frame 22. The flux conducting components are composed of a ferro-magnetic material, for example, steel. This dynamic speaker construction utilizes a solid pole flux conductor 18 secured to the rear flux conductor plate 16. This construction provides an economical speaker assembly that has been manufactured for many years. However, this construction suffers from the fundamental design flaw that degrades the audio reproduction quality. The solid pole flux conductor 18 acts to block the rearward propagating acoustic output emanating from the vibrating diaphragm 10. The area contained between the diaphragm 10 and the solid pole flux conductor 18 forms a closed chamber that traps the rearward propagating acoustic output. As a result, the rearward propagating acoustic output forms constructive and destructive waveform interference that is reflected and dissipated on the diaphragm 10. This distorted acoustic output negatively impacts the forward propagating acoustic output resulting in audio reproduction quality degradation.

FIG. 2 illustrates an improved prior art dynamic monopole speaker construction. This dynamic speaker is designed with the same components as described in FIG. 1 with the exception of the following components. The improved design utilizes a vented pole flux conductor 24 containing a cylindrical hole providing a passage to a rear chamber C1 formed by a sealed rear housing 26. The rear chamber C1 contains acoustic damping material 28 which acts to dampen the rearward propagating output by dissipating a portion of the rearward propagating acoustic output over time. However, this construction entraps half of the acoustic output energy within the limited volume of chamber C1 and does not adequately address the adverse effects caused by the fundamental design flaw. The stored acoustic output contained in the rear chamber is reflected and dissipated on the diaphragm 10 which negatively impacts the forward propagating acoustic output resulting in audio reproduction quality degradation.

SUMMARY OF THE INVENTION

Accordingly, it is the primary object of this invention to improve the audio reproduction quality of dynamic speakers used in home, automotive, and professional applications. It is another principal object of the present invention to provide a dynamic speaker design utilizing a diaphragm, voice coil assembly, and magnet system that produces acoustic output as a dipole radiator. It is a further object of the present invention to provide a method of utilizing the dipole radiating dynamic speaker design for tweeter and mid-range speaker applications used in home, automotive, and professional audio systems.

The present invention provides a significant advance in the art by providing a dynamic speaker that produces acoustic output as a dipole radiator. In contrast to prior art dynamic speaker design, the dipole radiator produces acoustic output of equal magnitude in the forward and rearward directions permitting the diaphragm to move only in response to the electrical input signal. In accordance with the present invention a venting means is provided to permit the rearward acoustic output to propagate away from the diaphragm, thus minimizing or eliminating the adverse effects that cause audio reproduction quality degradation. The dipole radiating dynamic speaker design disclosed herein utilizes vents that provide minimal obstruction to the rearward acoustic output propagation and thus in effect produces acoustic output as a dipole radiator.

The invention further provides a point source acoustic dipole output that produces superior imaging resolution, and improved audio reproduction accuracy compared to the prior art speaker design. The invention further provides an inexpensive means to manufacture a dipole radiating speaker with conventional dynamic speaker manufacturing techniques, equipment, and components. Previously dipole radiating speakers were only available in other more expensive speaker design technologies such as electrostatic, planar magnetic, and ribbon type.

The invention further provides a method of utilizing the dipole radiating dynamic speaker without the need for an enclosure by mounting the speaker on a panel device that permits the rearward acoustic output to propagate away from the diaphragm. The invention further provides a method of utilizing the dipole radiating dynamic speaker for mid-range applications with a front panel perimeter vented enclosure design that permits a portion of the acoustic output to directly exit the enclosure providing improved audio reproduction quality compared to prior art enclosure designs.

The dipole radiating dynamic speaker broadly comprises a diaphragm providing a surface for radiating acoustic output, a voice coil assembly for driving the diaphragm, and a magnet system for providing magnetic flux across the voice coil assembly. The speaker incorporates a vented pole flux conductor and a vent adjacent to the diaphragm to permit the rearward acoustic output to propagate away from the diaphragm providing acoustic output as a dipole radiator.

The dipole radiating dynamic speaker functions under the same electro-dynamic principles as conventional dynamic speakers. In operation, the diaphragm vibrates proportional to the electrical signal passing through the voice coil producing forward and rearward propagating acoustic output. The dipole radiating dynamic speaker construction utilizes a vented pole flux conductor that provides a passage for the rearward acoustic output that is generated by the diaphragm contained within the perimeter of the voice coil assembly. The vent located between the frame and the front flux conductor plate provides a passage of minimal obstruction for the rearward acoustic output that is generated by the diaphragm adjacent to the voice coil assembly. FIG. 7 illustrates the acoustic output passages provided by a typical dipole radiating dynamic speaker. It is readily apparent that the rearward propagating acoustic output travels away from the diaphragm thus minimizing or eliminating the adverse effects that cause sound quality degradation. By permitting the rearward propagating acoustic output to exit the rear of the speaker with minimal obstruction the diaphragm moves only in proportion to the electrical input signal and is not negatively impacted by trapped acoustic output. The speaker may additionally contain acoustic damping material to cover reflective surfaces to reduce acoustic reflections internal to the speaker.

Further objects and advantages of the present invention will become apparent as the following embodiments of the present invention are discussed in connection with the drawings. However, it is to be noted that the drawings provide fundamental concept illustration only and do not limit the scope of the invention.

DETAILED DESCRIPTION OF THE INVENTION

Figure 1:
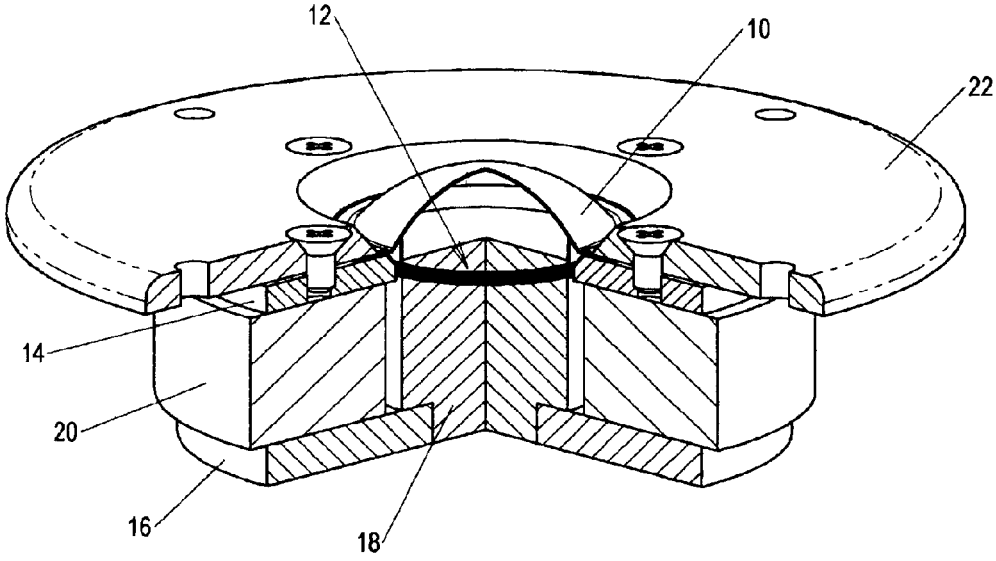
Prior Art Fig. 1
FIG. 1 illustrates a side elevation cross sectional view of a typical prior art dynamic monopole speaker design.
Figure 2:
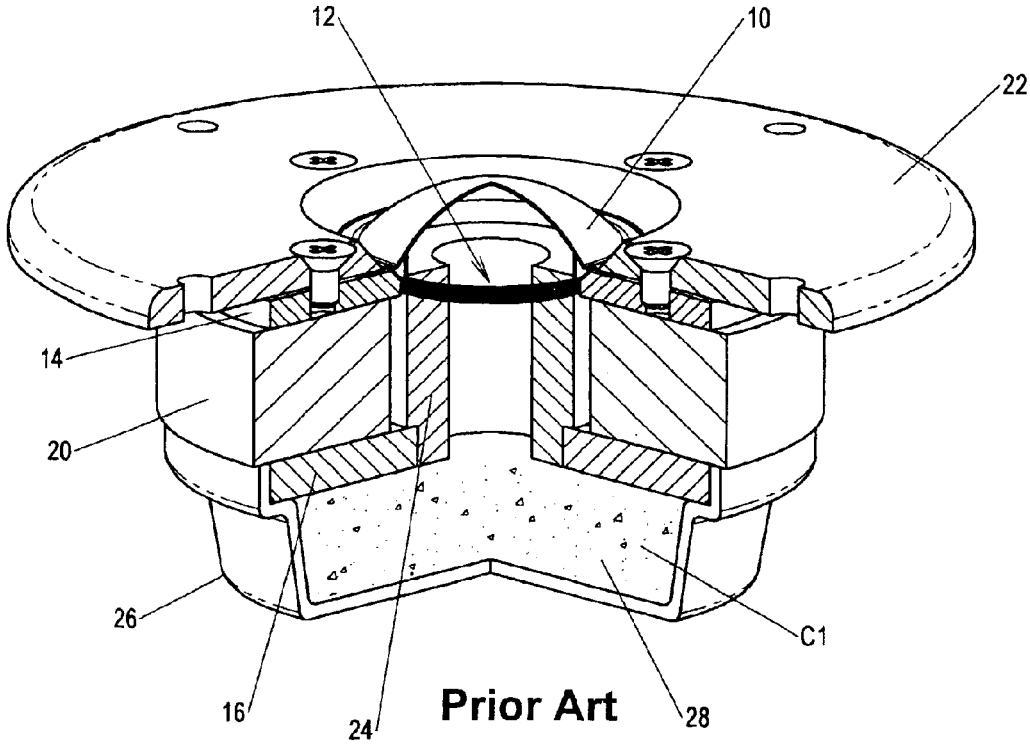
FIG. 2 illustrates a side elevation cross sectional view of an improved prior art dynamic monopole speaker design.
Figure 3:
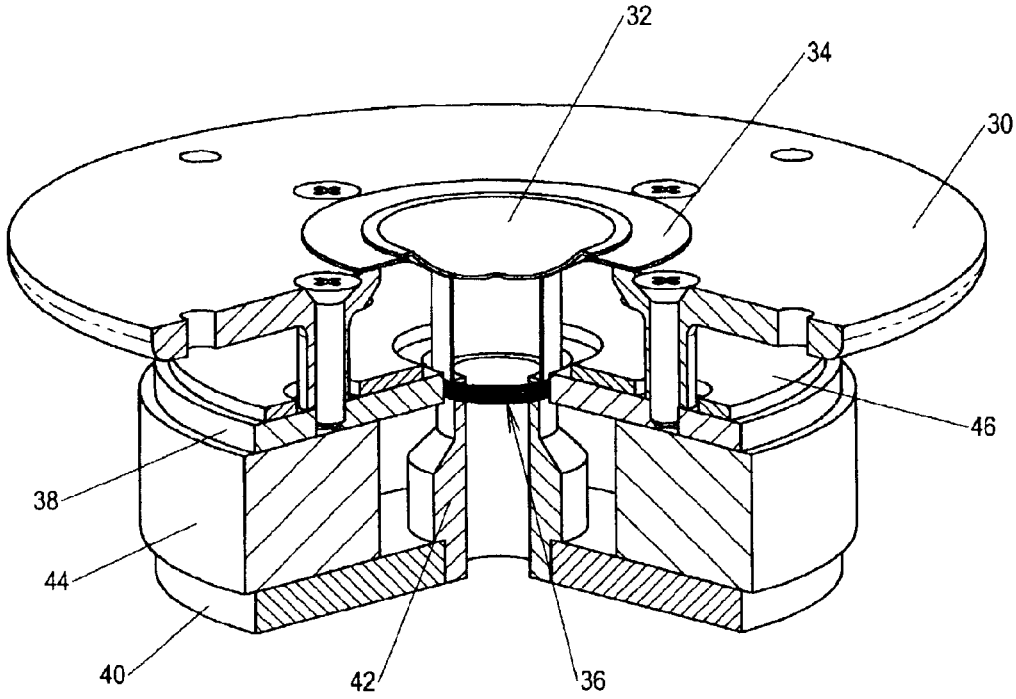
FIG. 3 illustrates a side elevation cross sectional view for a preferred embodiment of a dipole radiating dynamic speaker design.

Referring to FIG. 3, in accordance with the present invention the dipole radiating dynamic speaker broadly comprises a frame 30, diaphragm 32, suspension 34, voice coil assembly 36, front flux conductor plate 38, rear flux conductor plate 40, vented pole flux conductor 42, permanent magnet 44, and acoustic damping material 46.

The frame 30 contains a centrally located aperture for the purpose of supporting the diaphragm 32. In accordance with the present invention, the frame 30 comprises a plurality of integral standoff posts located on the rear surface that provide a vent between the frame 30 and the front flux conductor plate 38. This vent provides a passage of minimal obstruction for the rearward acoustic output to propagate away from the diaphragm 32.

The diaphragm 32 is preferably an inverted dome shape and composed of a suitably light weight rigid material. The diaphragm 32 perimeter is preferably attached with an adhesive to a suspension 34 that suspends the diaphragm within the speaker assembly. In accordance with the present invention, the diaphragm 32 may incorporate an integral suspension formed as a single device, thus eliminating the requirement for the suspension 34 component.

The suspension 34 is composed a suitably thin flexible material and permits the diaphragm 32 to move in response to electrical current flowing through the voice coil. The suspension 34 is attached to the front surface of the frame 30 at the inner circumferential edge of the aperture. Alternatively, the suspension 34 may be attached to the rear surface of the frame 30 at the inner circumferential edge of the aperture to increase the vent height dimension between the frame 30 and the front flux conductor plate 38. This construction provides a larger pathway area for the rearward acoustic output to propagate.

The voice coil assembly 36 is of conventional design and consists of a wire coil wound on the perimeter of a non magnetic cylindrical former. The voice coil wires are terminated to conventional electrically conductive terminals (not shown) by conventional manufacturing means. The diaphragm 36 is secured to the front circular edge of the cylindrical shaped voice coil assembly 36 with an adhesive. The voice coil assembly 36 diameter is generally proportioned to a size less than the diameter of the diaphragm 32. The voice coil assembly 36 is situated in a circular air gap formed between the front flux conductor plate 38 and the vented pole flux conductor 42. The frame 30 is positioned relative to the front flux conductor plate 38 enabling the voice coil assembly 36 to be aligned centrally within the air gap.

The vented pole flux conductor 42 is centrally located and conducts the magnetic flux from the rear flux conductor plate 40 to the air gap. Preferably, the vented pole flux conductor 42 contains an axially located hole that provides a passage of minimal obstruction for the rearward acoustic output to propagate away from the diaphragm 32. The vented pole flux conductor 42 is secured to the rear flux conductor plate 40 via conventional mechanical means and/or adhesive. Alternatively, the vented pole flux conductor 42 and the rear flux conductor plate 40 may be constructed as a single device. The vented pole flux conductor 42 may be of any shape that fits the mechanical constraints of the speaker assembly and is not limited to a cylindrical form, nor a specific ratio of hole size to outside diameter. The flux conducting components are composed of a ferro-magnetic material, for example, steel.

A permanent magnet 44 is secured with adhesive between the front flux conductor plate 38 and the rear flux conductor plate 40 forming a magnet assembly that provides the source of magnetic flux. Alternatively, an electromagnet may be utilized in place of the permanent magnet 44. The speaker may also utilize acoustic damping material 46 secured to the front flux conductor plate 38 to provide acoustic wave absorption of the rearward propagating acoustic output. Additionally, acoustic damping material may be located between the vented pole flux conductor 42 and the diaphragm 32 for reducing acoustic reflections.

Figure 4:
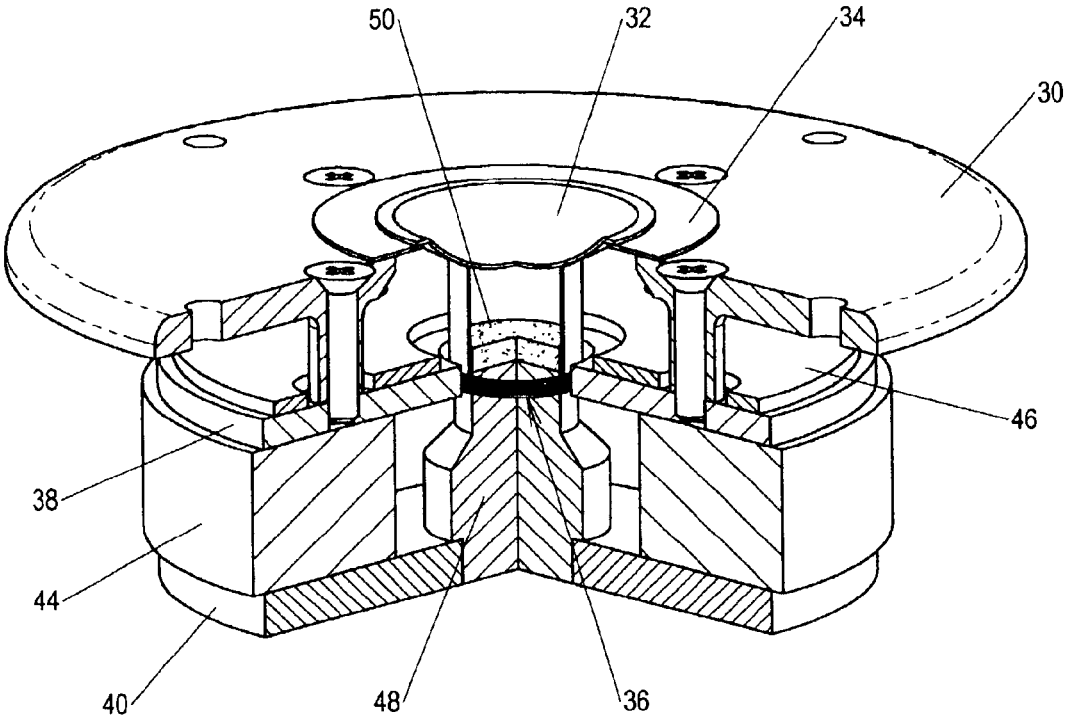
FIG. 4 illustrates a side elevation cross sectional view of a dipole radiating dynamic speaker design utilizing a solid pole flux conductor.

FIG. 4 illustrates an alternate embodiment of the dipole radiating dynamic speaker. The design is of similar construction as the apparatus described in FIG. 3 with the exception that the vented pole flux conductor 42 is replaced with the solid pole flux conductor 48 and acoustic damping material 50.

This design incorporates a solid pole flux conductor 48 providing increased flux conducting capacity over the design of FIG. 3. thus increasing the acoustic output efficiency. The solid pole flux conductor 48 is secured to the rear flux conductor plate 40 via conventional mechanical means and/or adhesive. The acoustic damping material 50 is secured to the solid pole flux conductor 48 to provide acoustic damping of the rearward propagating acoustic output. The voice coil assembly 36 may be of a conventional design or alternatively, the former may be acoustically porous to permit the rearward acoustic output to propagate away from the diaphragm 32. The former may contain holes, slots, or other form to permit acoustic propagation.

Figure 5:
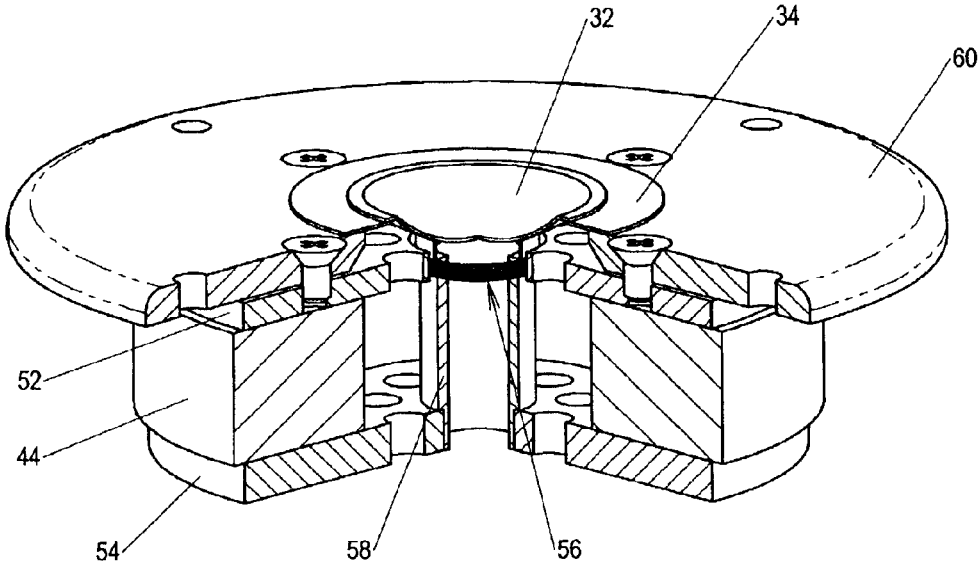
FIG. 5 illustrates a side elevation cross sectional view of a dipole radiating dynamic speaker design utilizing vented front and rear flux conductor plates.

FIG. 5 illustrates an alternate embodiment of the dipole radiating dynamic speaker. The design is of similar construction as the apparatus described in FIG. 3 with the exception that the front and rear flux conductor plates 38, 40, voice coil assembly 36, vented pole flux conductor 42, and the frame 30 are replaced with the vented front and rear flux conductor plates 52, 54, voice coil assembly 56, vented pole flux conductor 58 and frame 60.

The vented pole flux conductor 58 is secured to the vented rear flux conductor plate 54 via mechanical means and/or adhesive. Alternately, a solid pole flux conductor may be used in place of the vented pole flux conductor 58. The vented front and rear flux conductor plates 52 and 54 permit the rearward acoustic output to propagate away from the diaphragm. The vented front and rear flux conductor plates 52 and 54 may contain holes, slots, or other form to permit acoustic propagation. The flux conducting components are composed of a ferro-magnetic material, for example, steel.

Figure 6:
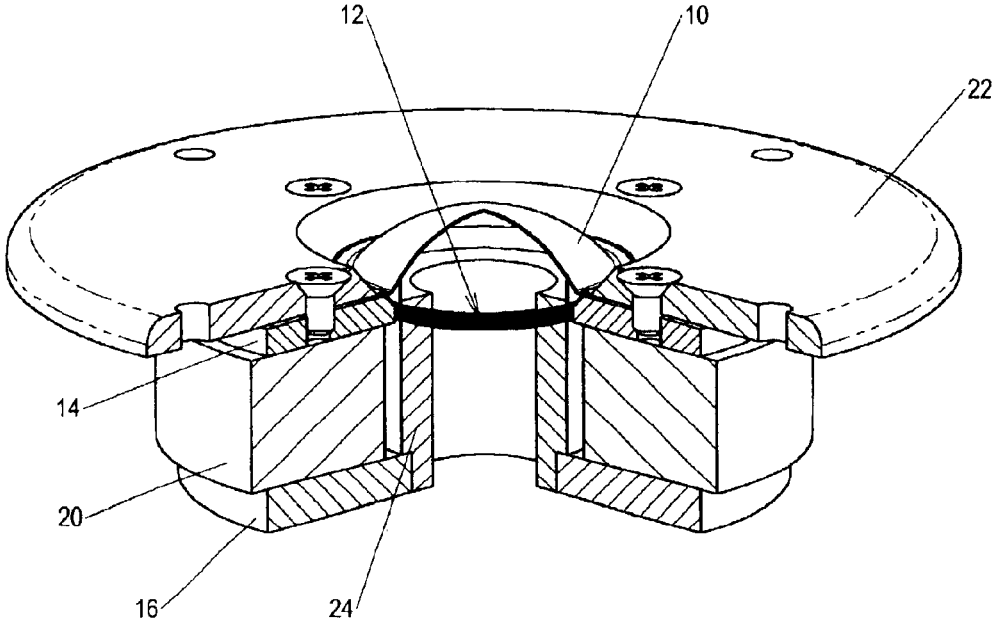
FIG. 6 illustrates a side elevation cross sectional view of a dipole radiating dynamic speaker design utilizing a conventional dome diaphragm.
Figure 7:
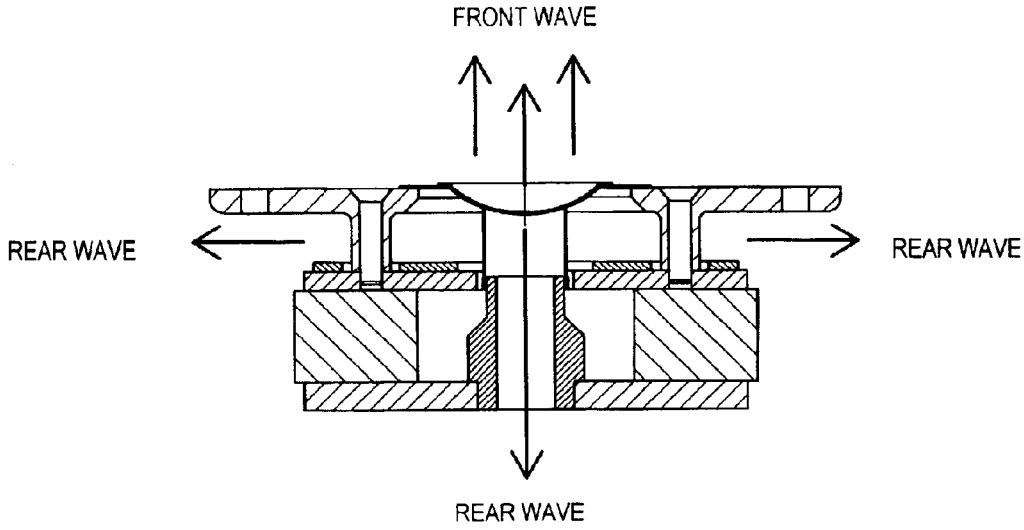
FIG. 7 illustrates a side cross sectional view of the acoustic output path for the dipole radiating dynamic speaker.

FIG. 6 illustrates an alternate embodiment of the dipole radiating dynamic speaker. The voice coil assembly 12 is of conventional design and consists of a wire coil wound on a non-magnetic cylindrical former. The voice coil assembly 12 is situated in a circular air gap formed between the front flux conductor plate 14 and the vented pole flux conductor 24. The voice coil wires are terminated to conventional electrically conductive terminals (not shown) by conventional manufacturing means.

The diaphragm 10 is secured to the front circular edge of the voice coil assembly 12 and to the frame 22 with an adhesive. The diaphragm 10 incorporates an integral suspension permitting the diaphragm 10 to move in response to electrical current flowing through the voice coil. The frame 22 is positioned relative to the front flux conductor plate 14 enabling the voice coil assembly 12 to be aligned centrally within the air gap.

The vented pole flux conductor 24 is secured to the rear flux conductor plate 16 via conventional mechanical means and/or adhesive. The vented pole flux conductor 24 may be of any shape that fits the mechanical constraints of the speaker assembly and is not limited to a cylindrical form. The vented pole flux conductor 24 conducts the magnetic flux from the rear flux conductor plate 16 to the air gap and provides a passage for the rearward acoustic output to propagate away from the diaphragm 10. The flux conducting components are composed of a ferro-magnetic material, for example, steel.

A permanent magnet 20 is secured with adhesive between the front flux conductor plate 14 and the rear flux conductor plate 16 forming a magnet assembly that provides the source of magnetic flux. The speaker may also contain acoustic damping fiber secured to the vented pole flux conductor 24 to provide acoustic wave absorption for the rearward propagating acoustic output.

Figure 8:
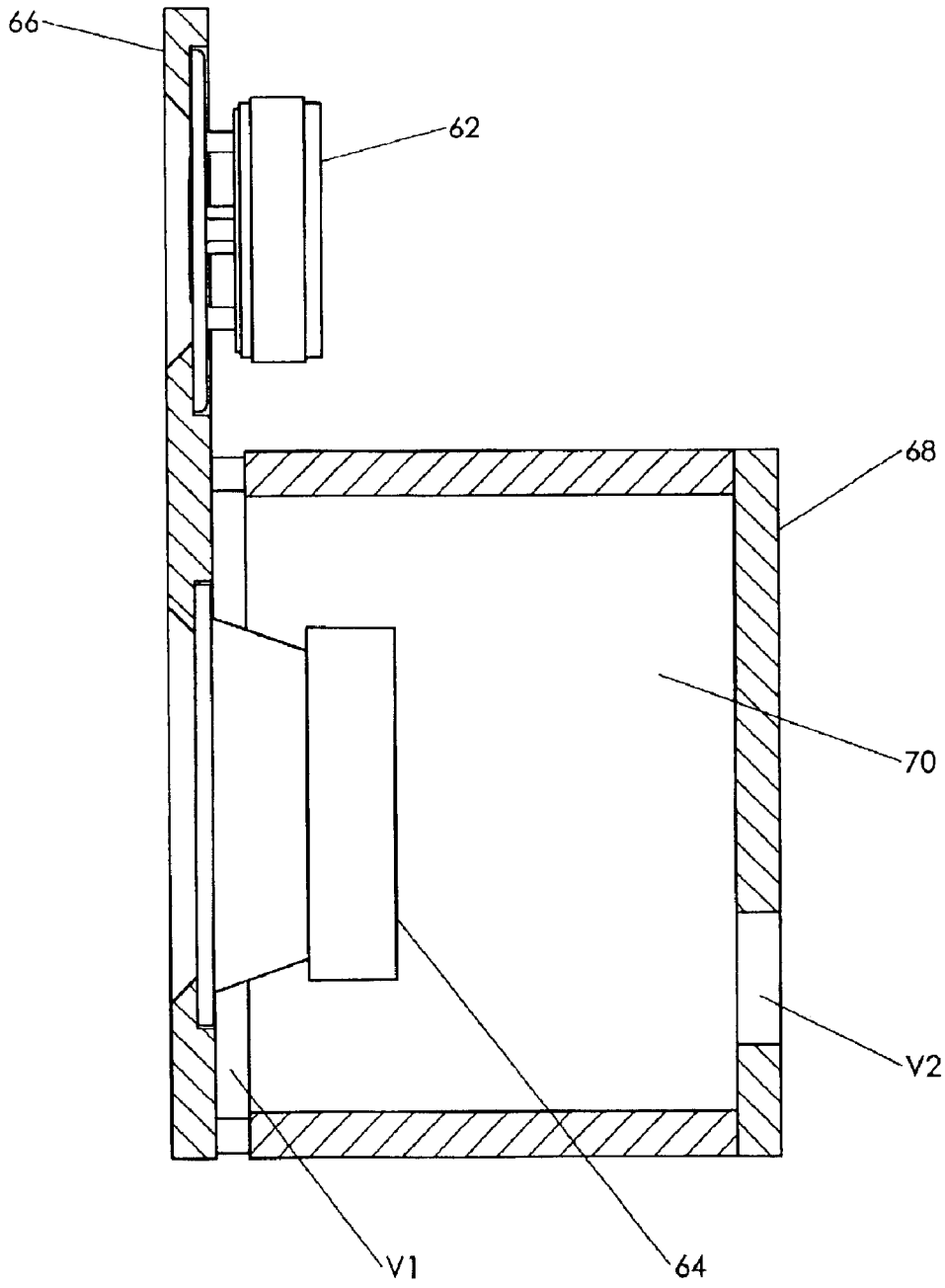
FIG. 8 illustrates a cross sectional view of a speaker mounting means utilizing dipole radiating dynamic speakers.

FIG. 8 illustrates a preferred method of utilizing the dipole radiating dynamic speaker design for tweeter and mid-range applications. The speaker system is broadly comprised of a dipole radiating tweeter 62, dipole radiating mid-range speaker 64, enclosure front panel 66, enclosure body 68, and acoustic damping fiber 70.

The dipole radiating tweeter 62 and dipole radiating mid-range speaker 64 are mounted to the enclosure front panel 66 via conventional means.

The enclosure front panel 66 is preferably constructed of a suitably rigid material and form that extends beyond the enclosure body 68. The enclosure body 68 is preferably constructed of a suitably rigid material, for example, medium density fiberboard. The dipole radiating tweeter 62 is located on the enclosure front panel 66 such that it is external to the enclosure body 68 permitting the rearward propagating acoustic output from the dipole radiating tweeter 62 to disperse in free space unobstructed. The dipole radiating mid-range speaker 64 is located on the enclosure front panel 66 such that the enclosure body 68 surrounds the rear of the dipole radiating mid-range speaker 64.

A means is provided such that a vent V1 is formed between the enclosure front panel 66 and the enclosure body 68 perimeter. The vent dimensions are selected to optimize the audio reproduction quality from the dipole radiating mid-range speaker 64. The enclosure body 68 generally contains acoustic damping fiber 70 for reducing acoustic reflections within the enclosure body 68. Additionally, a vent V2 of conventional form may be utilized for tuning the enclosure low frequency acoustic output.

The following dimensions and specifications describe a typical dipole radiating dynamic speaker design as illustrated in FIG. 3 for use in a tweeter application.

Diaphragm diameter=1.0 inch

Voice coil diameter=0.52 inches

Voice coil former height=0.30 inches

Voice coil layers=2

Voice coil height=0.08 inches

Voice coil wire=AWG 39

Voice coil resistance=4.0 ohms

Vented pole flux conductor outer diameter=0.50 inches

Vented pole flux conductor inside diameter=0.35 inches

Magnet system air gap=0.030 inches

Magnet system air gap height=0.10 inches

Magnet diameter=2.75 inches

Magnet height=0.63 inches

Frame vent height=0.35 inches

Diaphragm/voice coil assembly moving mass: 0.25 grams

Acoustic damping material thickness=0.063 inches

Acoustic output frequency range: 1000 Hertz to 15000 Hertz.

A preferred method for utilizing dipole radiating speakers in a system as illustrated in FIG. 8 is described below. The speaker system shall be capable of reproducing the frequency range of 80 Hertz to 15,000 Hertz utilizing two speakers. A crossover device of conventional design is utilized to provide the intended frequency signal for the appropriate speaker. For frequency production below 80 Hertz, a separate speaker called a subwoofer may be utilized. The design and utilization of a subwoofer is well known to those skilled in the art and is not described herein.

The dipole radiating tweeter shall provide acoustic output for the frequency range of 1000 Hertz to 15,000 Hertz. In operation, the dipole radiating dynamic tweeter may be mounted to a panel without an enclosure such that the diameter of the panel is selected to support the frequency range intended for the speaker. Acoustic wave theory requires that the panel diameter be at least the lowest wavelength divided by two in order to produce acoustic output without attenuation. For example, the above speaker will provide acoustic output down to 1000 Hertz requiring the panel diameter to be at least this wavelength divided by two. This calculation [1100 ft/s÷1000 Hz÷2×12 in/ft] yields a panel diameter of at least 6.6 inches to support acoustic output down to 1000 Hertz. The dipole radiating tweeter should be mounted to the panel such that the acoustic output is permitted to propagate unobstructed away from the diaphragm. Acoustic damping material may be utilized on the front and rear panel surfaces to reduce acoustic reflections from the panel. This utilization of the dipole radiating dynamic tweeter is the preferred method as the acoustic output is permitted to travel away from the diaphragm unobstructed in both the forward and rearward directions thus minimizing the adverse effects that cause sound quality degradation.

A dipole radiating mid-range speaker shall be utilized to provide the frequency range from 80 Hertz to 1000 Hertz. It is possible to mount the dipole radiating mid-range speaker to a panel without an enclosure to reproduce this frequency range, however the panel diameter would be large and may require equalization of the lower frequencies in order to produce accurate acoustic output. Alternatively, this task is effectively accomplished through the utilization of an enclosure. There are various enclosure types that are utilized in current production such as bass reflex, acoustic suspension, and transmission line. It is not with in the scope of this patent to describe the advantages, disadvantages, and characteristics of each type. However, the use of a front panel perimeter vented enclosure design will provide significant improvement of the acoustic output quality compared to prior art enclosures.

Referring to FIG. 8, the dipole radiating tweeter 62 and dipole radiating mid-range speaker 64 are mounted to the enclosure front panel 66. The vent V1 dimension between the enclosure front panel 66 and the enclosure body 68 is adjusted to optimize the enclosure for the most accurate acoustic output from the dipole radiating mid-range speaker 64. A typical gap dimension for vent V1 for the purpose of experimentation is 0.25 inches. The advantage of this enclosure design is a portion of the mid-range acoustic output is permitted to directly exit the enclosure providing improved acoustic quality compared to prior art enclosure designs. The enclosure may additionally incorporate holes, slots, or ports for the purpose of tuning the enclosure low frequency acoustic output.

The front panel perimeter vented enclosure design may be applied to floor-standing or a small bookshelf designs and is also applicable to conventional dynamic mid-range and woofer speakers. In addition, alternative embodiments utilizing this enclosure design will be obvious to those skilled in the art and are not limited to the example described above.

While the above descriptions provide some specific design concepts, these should not be construed as limitations on the scope of the invention, but rather as examples of various embodiments. It should be apparent to those skilled in the art that various other revisions, omissions and additions in the form and detail thereof may be made therein without departing from the spirit and scope of the invention. Thus the scope of the invention should be determined by the appended claims and their legal equivalents, rather than solely by the examples given.

I claim:

1. A dipole radiating dynamic speaker comprising:

a frame characterized as a rigid plate with a centrally located aperture and rear surface comprising a plurality of integral standoff posts of minimal width secured to a magnet assembly comprising a front flux conductor plate, permanent magnet, and rear flux conductor plate: and a diaphragm characterized as a rigid inverted dome secured to said frame at the edge of the aperture: and a vent between said frame and said magnet assembly whereby rearward acoustic output is permitted to propagate away from said diaphragm: and a voice coil assembly secured to the center of said diaphragm disposed in an air gap within said magnet assembly: and acoustic damping material located between said magnet assembly and said frame for reducing acoustic reflections: and a pole flux conductor comprising a vent located axially whereby rearward acoustic output is permitted to propagate away from said diaphragm.

2. The dipole radiating dynamic speaker according to claim 1, further includes a suspension composed of suitably thin flexible material secured to the diaphragm perimeter and to said frame at the edge of the aperture.

3. The dipole radiating dynamic speaker according to claim 1, wherein said magnet assembly comprises an electromagnet.

4. The dipole radiating dynamic speaker according to claim 1, further includes acoustic damping material located between said pole flux conductor and said diaphragm for reducing acoustic reflections.

5. A dipole radiating dynamic speaker comprising:

a frame characterized as a rigid plate with a centrally located aperture and rear surface comprising a plurality of integral standoff posts of minimal width secured to a magnet assembly comprising a front flux conductor plate, permanent magnet, and rear flux conductor plate: and a diaphragm characterized as a rigid inverted dome secured to said frame at the inner edge of the aperture: and a vent between said frame and said magnet assembly whereby rearward acoustic output is permitted to propagate away from said diaphragm: and a voice coil assembly secured to the center of said diaphragm disposed in an air gap within said magnet assembly: and acoustic damping material located between said diaphragm and said pole flux conductor: and a pole flux conductor of cylindrical form characterized in that the component is solid.

6. The dipole radiating dynamic speaker according to claim 5, further includes vent means whereby acoustic output is permitted to propagate through the voice coil former away from said diaphragm.

* * * * *